United States Patent [19]

Lhenry et al.

[11] Patent Number: 4,523,896

[45] Date of Patent: Jun. 18, 1985

[54] CENTRIFUGAL COMPRESSOR

[75] Inventors: Bernard Lhenry; Max Roustan, both of Le Creusot, France

[73] Assignee: Creusot-Loire, Paris, France

[21] Appl. No.: 494,844

[22] Filed: May 16, 1983

[30] Foreign Application Priority Data

Jun. 4, 1982 [FR] France ..... 82 09771

[51] Int. Cl.[3] ..... F04B 35/04; F16C 39/06; F04D 29/08

[52] U.S. Cl. ..... 417/244; 417/350; 417/365; 417/366; 417/423 R; 308/10; 415/172 R

[58] Field of Search ..... 417/244, 350, 365, 366, 417/89, 371, 414, 423 R; 308/10; 415/170 A, 172 R, 100

[56] References Cited

U.S. PATENT DOCUMENTS

| | | | |
|---|---|---|---|
| 3,088,042 | 4/1963 | Robinson | 417/371 |
| 3,099,385 | 7/1963 | Elford | 417/407 |
| 3,137,237 | 6/1964 | Zagar et al. | 417/423 R |
| 3,272,129 | 9/1966 | Leopold | 417/350 |
| 3,296,824 | 1/1967 | Rohrs et al. | 417/350 |
| 3,740,163 | 6/1973 | Schinnerer et al. | 417/407 |
| 3,951,573 | 4/1976 | Dunning et al. | 417/424 |
| 4,037,991 | 7/1977 | Taylor | 417/89 |
| 4,116,592 | 9/1978 | Cherny et al. | 417/424 |
| 4,152,092 | 5/1979 | Swearingen | 415/172 R |
| 4,180,946 | 1/1980 | Heijkenskjold et al. | 308/10 |
| 4,438,987 | 3/1984 | Kapaan | 308/10 |

FOREIGN PATENT DOCUMENTS

| | | | |
|---|---|---|---|
| 303012 | 3/1915 | Fed. Rep. of Germany | 417/89 |

*Primary Examiner*—Cornelius J. Husar
*Assistant Examiner*—Peter M. Cuomo
*Attorney, Agent, or Firm*—Pollock, Vande Sande & Priddy

[57] ABSTRACT

A centrifugal compressor capable of rotating at high speed by means of an electric motor comprises two compression stages cantilevered one at each end of a shaft, an electric motor of which the rotor is carried by a central part of the shaft, magnetic bearings, and a magnetic stop. The motor, the bearings and the stop are placed in a housing placed under a partial vacuum. Two facial gaskets adjustable as a result of longitudinal displacement of a component and of the shaft seal the compressor and ensure sealing of the space within the housing.

4 Claims, 5 Drawing Figures

CENTRIFUGAL COMPRESSOR

FIELD OF THE INVENTION

The present invention relates to improvements in centrifugal compressors capable of rotating at high speed by means of an electric motor.

A centrifugal compressor is a rotating machine which incorporates at least one wheel serving as an impeller and at least one extraction volute acting as a diffuser, the function of which is to compress a gaseous fluid, such for example as the gas marketed under the trademark Freon. To achieve a substantial compression rate per wheel, for example of the order of 2.5, it is necessary to operate at very high rotational speeds of the order of one or more tens of thousands of revolutions per minute.

BACKGROUND OF THE INVENTION

Centrifugal compressors rotating at high speed are known, and in these a mechanical speed multiplier is located between an electric drive motor and the shaft which drives the wheel or wheels of the compressor. In these known compressors, a flexible clutch, called a low-speed clutch, is located between the rotor of the electric motor and the input wheel of the multiplier, and another flexible clutch, called a high-speed clutch, is located between the output pinion of the multiplier and the rotor of the compressor.

These known compressors have a number of disadvantages, including the following:

the multiplier and its associated clutches require costly lubrication arrangements with a high energy consumption;

the problem of critical speed is complex because of the multiplicity of the rotating parts;

because of the large number of parts, the reliability of the compression unit is not very high;

problems of alignment arise as a result of the presence of several moving parts;

since the compression unit is not compact, the various components are generally arranged on different bases and supports, and this has a disadvantageous effect on the cost of the whole system.

SUMMARY OF THE INVENTION

According to the present invention, there is provided a centrifugal compressor capable of rotating at high speed, comprising:

a single shaft carrying at least one wheel cantilevered on at least one of its two ends for setting the fluid to be compressed in motion;

a high-speed electric motor comprising a rotor carried by said shaft and located in a central portion of said shaft;

at least two magnetic bearings for supporting said shaft;

a magnetic stop for adjusting the axial position of said shaft;

a housing surrounding at least said electric motor, said magnetic bearings and said magnetic stop;

at least one first facial sealing means located at a first end of said compressor and adjustable through axial displacement of said shaft by means of said magnetic stop;

at least one second facial sealing means located at the other end of the compressor and adjustable through controlled longitudinal displacement of a supporting component; and circuit means for placing the space within said housing under a predetermined partial vacuum.

BRIEF DESCRIPTION OF THE DRAWINGS

An embodiment according to the invention will now be described, by way of example only, with reference to the accompanying drawings in which.

DESCRIPTION OF PREFERRED EMBODIMENT

Figure 1:
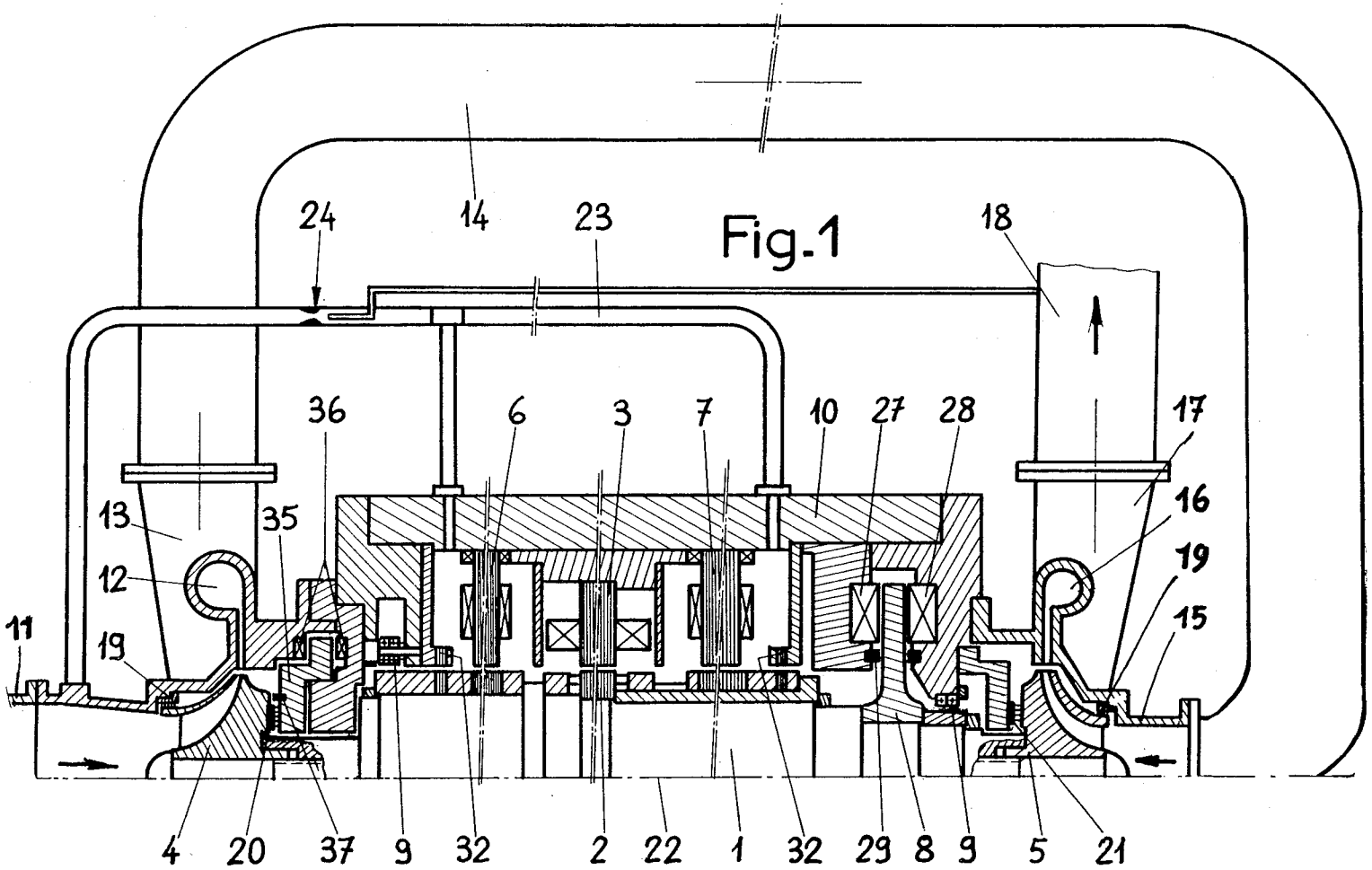
FIG. 1 is a longitudinal section view of an embodiment of a two-stage centrifugal compressor according to the invention.

In FIG. 1, the reference numeral 1 denotes the shaft of the compressor. The shaft 1 carries at its center the rotor element 2 of a high-speed electric motor, surrounded by a stator element 3. Such a motor, which is presently available is capable of supplying a power of one to several thousand kilowatts for a rotational speed of 10,000 to 15,000 revolutions per minute.

The shaft 1 carries, cantilevered on its respective ends, a first suction wheel 4, forming the rotating element of the first compression stage, and a second suction wheel 5, forming the rotating element of the second compression stage. The shaft 1 is supported by means of two magnetic bearings 6 and 7 which are adjustable under the control of position detectors 32 and with which is associated a magnetic stop 8 for adjusting the longitudinal position of the shaft 1. Touchdown bearings 9, on which the shaft 1 rests in the absence of electric current, are also shown in FIG. 1.

The assembly consisting of the motor 2, 3, the magnetic bearings 6 and 7 and the magnetic stop 8 is placed in a housing 10.

The wheel 4 of the first stage is connected to a low-pressure pipe 11, called the suction pipe, and to a delivery or extraction volute 12 of the first stage, which itself opens into the delivery pipe 13 of the first stage.

The compressed fluid emerging at pipe 13 is conveyed via a pipe 14 to a suction sleeve 15 of the second compression stage incorporating the second wheel 5. Like the first, this second stage comprises an extraction volute 16 and a delivery pipe 17 connected to the extraction pipe 18 supplying the compressed outlet fluid.

The compression stages are both provided with sealing means comprising not only an axial labyrinth seal or gasket 19 on the covers of the centrifugal wheels 4 and 5, but also facial seals or gaskets 20, 21, i.e., gaskets perpendicular to the axis 22 of the shaft 1, these gaskets being labyrinth gaskets which bear on an abradable smooth face and which are adjustable through axial displacement of the abradable faces, as will be explained in more detail below.

The space within the housing 10 is maintained at a specific pressure. This pressure may, for example, be atmospheric pressure, the suction pressure prevailing in the feed pipe 11, or advantageously, as in the embodiment illustrated, a pressure clearly below the feed pressure of the assembly.

Figure 5:
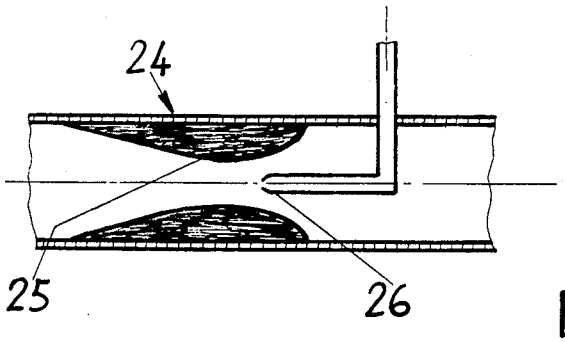
FIG. 5 is an enlarged diagrammatic view of a part of the compressor of FIG. 1.

As shown, the space within the housing 10 is put under a partial vacuum by connecting the space to the suction pipe 11 by a tube 23 incorporating a partial-vacuum circuit 24 which is shown on a larger scale in FIG. 5, and which comprises, very simply, an ejector, the neck 25 of which is associated with an injection nozzle 26 connected to the delivery pipe 18 of the second stage of the compressor. A pressure in the housing 10 which is equal to approximately one third of the suction pressure in the pipe 11 is obtained in this way.

Alternatively, to apply the suction pressure to the inner space of the housing 10, it is sufficient not to supply the nozzle 26 of the injector 24.

The means for adjusting the facial gaskets 20 and 21 will now be described by reference to FIGS. 2 and 3.

Figure 3:
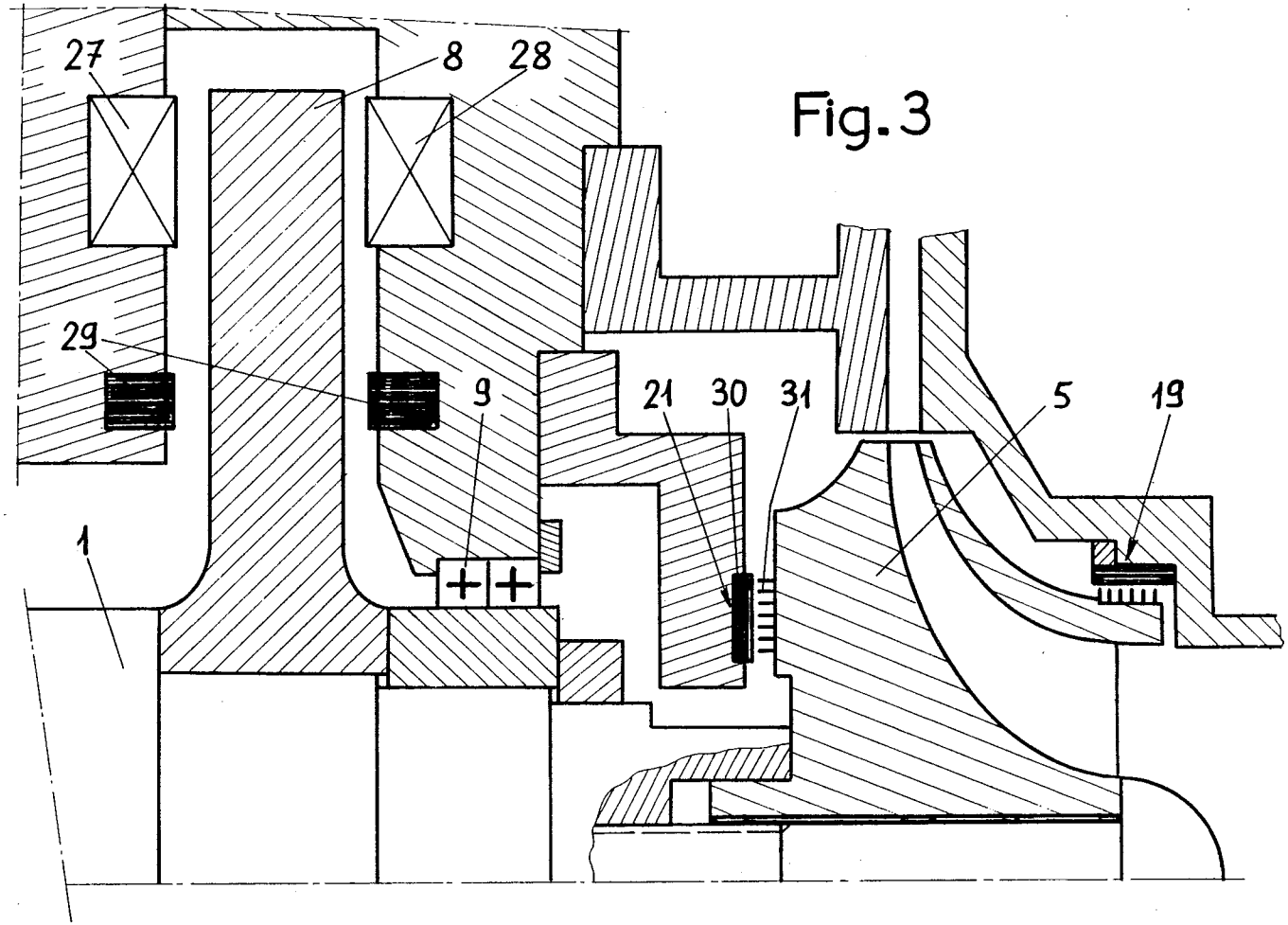
FIG. 3 is a sectional view of the magnetic stop of the compressor of FIG. 1, the wheel of the second stage and its associated gaskets.

Referring first to FIG. 3, the magnetic stop 8 is associated with two stator elements 27, 28 and with an axial-position detector 29. The detector 29 and the stator elements 27, 28 are connected to a control assembly which makes it possible to adjust the longitudinal positon of the stop 8 and therefore of the shaft 1, in order to obtain a minimum play between the abradable element 30 of the facial gasket 21 and the labyrinth 31 which faces it.

Figure 2:
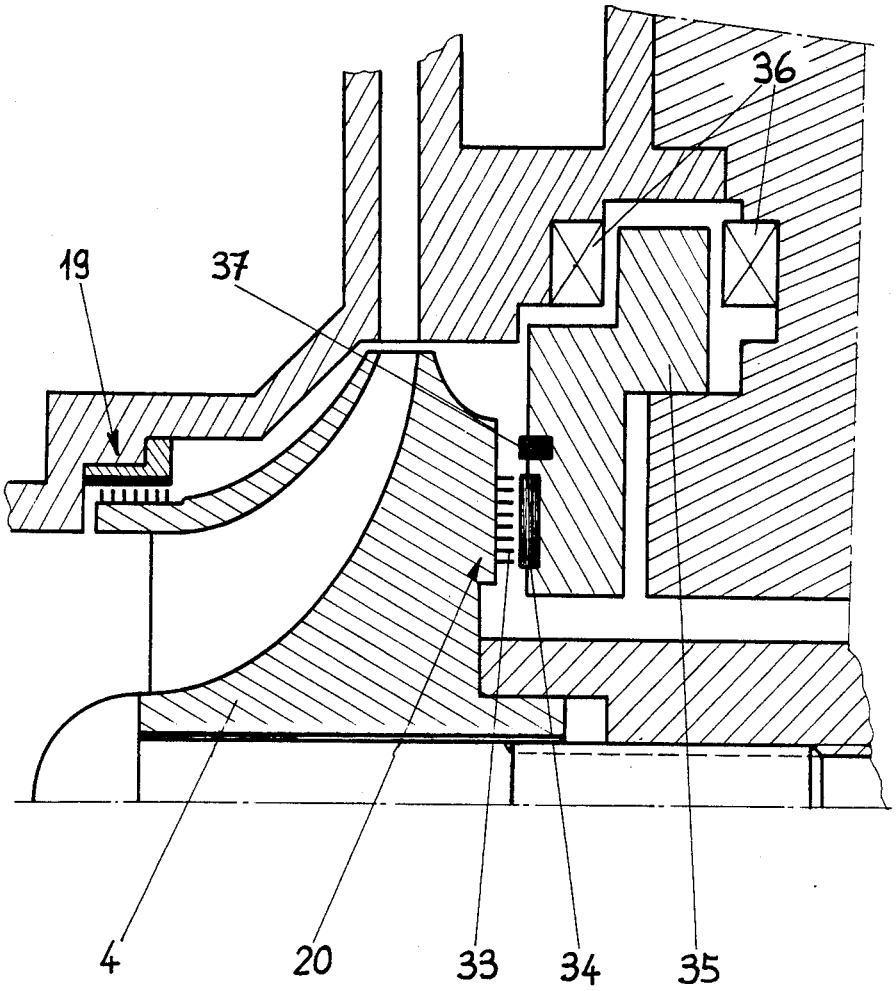
FIG. 2 is a sectional view of the wheel of the first stage of the compressor of FIG. 1 and its associated gaskets.

Referring now to FIG. 2, the facial gasket 20 likewise incorporates a labyrinth 33 which faces a smooth and abradable part 34, but this abradable part 34 is carried by a magnetizable component 35 which moves under the action of the current passing through magnetizing coils 36 and under the control of a position detector 37 connected to the central electronic control unit of the compressor. The currents passing through the coils 27, 28 and 36 are regulated by the central electronic unit in such a way as to obtain a minimum play both between the elements 30 and 31 of the facial gasket 21 and between the elements 33 and 34 of the facial gasket 20.

Figure 4:
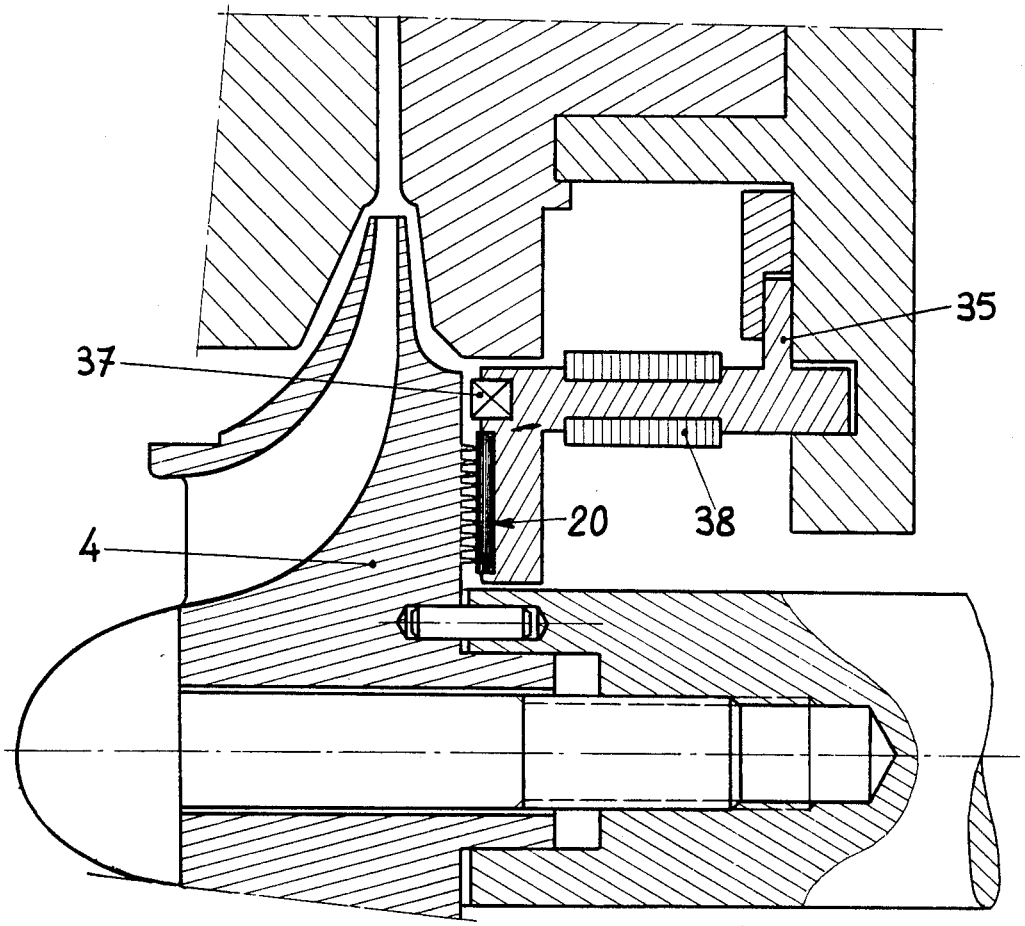
FIG. 4 is a sectional view of an alternative embodiment of a device for adjusting the facial gasket associated with the wheel of the first stage of the compressor of FIG. 1.

FIG. 4 shows an alternative form of the means for adjusting the facial gasket 20, in which the supporting component 35 is not displaceable as a result of electromagnetic action, but can expand to a greater or lesser extent by means of a heating resistor 38 fed with an electric current, the intensity of which is controlled by the position detector 37.

In the above described embodiments, gasket 20, 21 not only seal the second stages of the compressor but also seal the housing 10. It will be appreciated that the housing 10 may be sealed, if required, by the provision of additional sealing means independent of the gaskets sealing the stages of the compressor.

We claim:

1. A centrifugal compressor capable of rotating at high speed, comprising (a) a single shaft carrying at least two compressor wheels cantilevered on its two ends for setting in motion fluid to be compressed;

(b) a high-speed electric motor comprising a rotor carried by said shaft and located in a central portion of said shaft;

(c) at least two magnetic bearings for supporting said shaft;

(d) a magnetic stop for adjusting the axial position of said shaft;

(e) a housing surrounding at least said electric motor, said magnetic bearings and said magnetic stop;

(f) at least one first facial sealing means located at one of said compressor wheels and adjustable as a result of axial displacement of said shaft by means of said magnetic stop;

(g) at least one second facial sealing means located at the second compressor wheel and adjustable as a result of a controlled longitudinal displacement of a supporting component; and (h) circuit means for placing the space within said housing under a predetermined partial vacuum.

2. A centrifugal compressor as claimed in claim 1, wherein said circuit means comprises pipe means connecting said space within said housing to a suction pipe of said compressor.

3. A centrifugal compressor as claimed in claim 1, wherein said circuit means includes a device for generating a partial vacuum by means of suction.

4. A centrifugal compressor as claimed in claim 3, wherein said device for generating a partial vacuum by means of suction comprises at least one injector and means connecting said injector to a delivery pipe of said compressor.

* * * * *